United States Patent [19]

Maloney

[11] 4,017,335

[45] Apr. 12, 1977

[54] LIQUID PHOSPHATIZING COMPOSITION AND USE THEREOF

[75] Inventor: James E. Maloney, Eagan, Minn.

[73] Assignee: Economics Laboratory, Inc., St. Paul, Minn.

[22] Filed: Oct. 30, 1975

[21] Appl. No.: 627,082

[52] U.S. Cl. ..... 148/6.15 R; 252/390

[51] Int. Cl.[2] ..... C23F 7/10

[58] Field of Search ..... 148/6.15 R; 252/307, 252/350, 390; 106/14

[56] References Cited

UNITED STATES PATENTS

| | | | |
|---|---|---|---|
| 1,329,573 | 2/1920 | Allen | 148/6.15 R |
| 2,657,156 | 10/1953 | Hyam et al. | 148/6.15 R |
| 2,724,668 | 10/1955 | Russell | 148/6.15 R |
| 2,766,153 | 10/1956 | Russell | 148/6.15 R |
| 2,769,737 | 11/1956 | Russell | 148/6.15 R |
| 3,060,066 | 10/1962 | Ross et al. | 148/6.15 R |
| 3,152,018 | 10/1964 | Pollard | 148/6.15 R |
| 3,420,715 | 1/1969 | Ayres | 148/6.15 R X |
| 3,511,784 | 5/1970 | Riggs et al. | 252/307 X |
| 3,615,912 | 10/1971 | Dittel et al. | 148/6.15 R |
| 3,726,720 | 4/1973 | Guhde | 148/6.15 R |
| 3,729,346 | 4/1973 | Gotta et al. | 148/6.15 R |

*Primary Examiner*—Ralph S. Kendall
*Attorney, Agent, or Firm*—Thomas M. Meshbesher

[57] ABSTRACT

The disclosed organic ammonium phosphate salt concentrates can be diluted with water in the weight ratio of from 1:5 to 1:250 (concentrate:water) and used in bath, spray, or steam phosphatizing (sometimes called "phosphating"). These concentrates and the resulting diluted solution are reasonably pH-stable in the pH range of 3.0 to 5.5. Preferably, the concentrates contain a buffer, various surfactants, and, particularly for low temperature use (e.g. 20°–55° C.) an accelerator system. The concentrates are well suited to automatic dispensing of a phosphatizing spray or make-up solution (for a bath); they are efficient at low temperatures; and they have good storage stability.

13 Claims, No Drawings

LIQUID PHOSPHATIZING COMPOSITION AND USE THEREOF

FIELD OF THE INVENTION

This invention relates to the treatment of ferrous metal surfaces for the purpose of reducing their susceptibility to corrosion and/or to prepare them for coating operations, e.g. painting. An aspect of this invention relates to an art generally referred to as "phosphatizing", i.e. the treatment of a metal surface to provide a coating of relatively compact, insoluble metal phosphates strongly adherent to the metal. A further aspect of this invention relates to a liquid concentrate which can be conveniently dispensed or conveyed to an aqueous phosphatizing bath or spray head (for spray phosphatizing) or steam spray phosphatizing. Further aspects of this invention relate to the resulting diluted concentrate and methods of using it.

DESCRIPTION OF THE PRIOR ART

Generally speaking, this invention relates to an improvement upon the phosphate coating methods and compositions described in U.S. Pat. No. 3,060,066 (Ross et al), issued Oct. 23, 1962, hereinafter referred to as Ross et al.

One of the difficulties with solutions discussed in Ross et al is the problem of stabilizing the pH of the phosphatizing solution. The endpoint for the neutralization of one equivalent of phosphoric acid with one equivalent of a monofunctional base occurs approximately in the middle of the pH range most desirably maintained during the phosphatizing of ferrous metal surfaces. At or near this endpoint, the pH is extremely sensitive to changes in concentration of either acid or base. It is possible to continuously adjust the pH with additions of phosphoric acid, sodium hydroxide, or other acids and bases, but this method of adjustment can become so tedious that it may even be totally impractical, particularly when a minimum of man-hours of supervision or labor is required, e.g. in a partially or totally automated phosphatizing process.

Ross et al discovered that a very strong buffering effect could be obtained with compounds such as sodium silicofluoride. With the buffering compounds present, the slope of the pH versus base concentration curve could be decreased, thus decreasing the pH-sensitivity of the phosphatizing solution. Ross et al were able to provide a dry composition containing sodium acid phosphates, sodium silicofluoride, and other ingredients which could be dissolved in water to give concentrations of from about 1 to 5 ounces per gallon, thereby producing a coating solution having a pH in the range of from about 3.8 to about 5.2.

The silicofluorides are somewhat unusual compounds. The sodium salt of fluosilicic acid is perhaps one of the least soluble of the known sodium salts, its solubility being less than about 0.7 weight percent. Potassium silicofluoride is even more sparingly soluble. The situation is very similar with respect to the titanofluorides and zirconofluorides. Fortunately for the Ross et al process, the low solubility of sodium silicofluoride was still more or less adequate to provide a sufficient concentration of buffering compound in the use solution, i.e. in the phosphatizing spray or phosphatizing bath. (The typical phosphatizing bath or spray contains only a few percent of active ingredients, the balance being water.) In short, for a solid powder intended for addition to the huge volume of water required for a spray or a bath, the water solubility of the powdered material was not very critical and could be less than 1%, at least with respect to some of its components.

Despite the technical success of the Ross et al solid compositions and similar powders designed for solution in large volumes of water, these solid compositions are now approaching obsolescence. Recent developments in the phosphatizing art have shifted the emphasis toward liquid concentrates, the use of which can further reduce the amount of man-hours of labor and supervision required to successfully carry out a mass production-type phosphatizing process. Typically, phosphatizing compositions are used in one of two ways. First, they may be sprayed onto a metal surface from a tank or reservoir. Second, the surfaces to be phosphatized may be immersed in a phosphatizing bath or chamber. In the immersion technique, it is generally necessary to continuously or intermittently add make-up ingredients or make-up solutions to the bath or chamber. In either method, it is cumbersome to maintain a tank or other storage facility in which active ingredients are diluted to the use concentration. A far simpler and more efficient procedure is now called for in the phosphatizing industry. In this procedure, the phosphatizing ingredients would be shipped in standard containers (e.g. shipping drums) in liquid concentrate form. This permits the drum to be tapped in the usual manner, so that a pump or other dispensing/metering means can be introduced into the system. With proper metering of the concentrate (directly from the drum) and a suitable dilution medium, which can be plain water, a continuous flow of use solution is provided for spraying or make-up purposes.

In another recent trend in the phosphatizing art — generally attributed to the steadily shrinking availability of energy — temperatures in the phosphatizing zone (i.e. the bath or the spray pattern) are being set lower and lower. Lower temperatures may mean longer contact times and lower production efficiency; however, the increasing expense of energy leaves little alternative to such inefficiency. When energy was plentiful, phosphatizing zone temperatures in excess of 160° F. or even, e.g. with steam, above 180° F. (above 70° C. or even above 80° or 85° C.) could be commonplace. Today, the goal is to achieve phosphatizing with adequate efficiency at temperatures ranging from normal ambient to about 150° F. (about 65° C.), which necessitates the need for accelerated performance of the phosphatizing compound.

Still another development in the phosphatizing art relates to the number of steps required to provide the fully prepared, phosphatized surface. If time, space, manpower, etc., permit, the so-called five-step process can be used, i.e. a process comprising the steps of: (a) cleaning the metal surfaces; (b) rinsing; (c) treatment with the phosphatizing agent in the phosphatizing zone; (d) rinsing with water; and (e) rinsing with dilute phosphate or chromate or the like — the so-called after-treatment rinse. (Virtually all phosphatizing processes have in common a drying step which follows the after-treatment rinse.) For the sake of efficiency, it is becoming particularly desirable to combine one or more of these steps; e.g. combining (a) and (c) with the omission of step (b), or to use phosphatizing product in multiple stages. To achieve cleaning of the metal surface and phosphatizing in substantially a single step, it is desirable to include degreasers, i.e. degreasing surfactants, in the phosphatizing bath or spray.

The formulation of a suitable phosphatizing concentrate, particularly when the goals of reducing the phosphatizing temperatures and the number of steps in the phosphatizing process are also sought, can be complicated and difficult, particularly if pH stability or buffering of the phosphatizing spray or bath is also required. In a liquid aqueous concentrate, the buffer should be present in substantially more than 0.7% concentration (e.g. 1–10% concentration by weight), which virtually eliminates the possibility of using sodium silicofluoride or the like as a buffer. Furthermore, the phosphate compound and other active ingredients which will be present in relatively high concentrations may create solution instability or other storage problems; any surfactants in the concentrate could be salted out by inorganic or highly polar ingredients, etc.

The present state of the art is not believed to provide guidelines for solving these problems. It is certainly true, however, that the prior art contains an almost overwhelming mass of disclosure regarding phosphatizing compositions and methods, particularly in the patent literature. It would be difficult to cite anything more than a representative sampling of the most pertinent prior art, and it is believed that the following list of patents is reasonably representative of this prior art.

| U.S. Pat. | Patentee | Date |
|---|---|---|
| 2,318,606 | Max T. Goebel, et al | May 11, 1943 |
| 2,456,947 | George W. Jernstedt | December 21, 1948 |
| 2,737,498 | Herbert Manfred Freud | March 6, 1956 |
| 2,835,618 | Heinz Keller, et al | May 20, 1958 |
| 2,840,498 | Carl Eugene Logue, Jr., et al | June 24, 1958 |
| 3,060,066 | Wilford H. Ross, et al | October 23, 1962 |
| 3,109,757 | Earl R. Reinhold | November 5, 1963 |
| 3,129,121 | Edward A. Rodzewich | April 14, 1964 |
| 3,493,440 | Ronald Arthur Ashdown | February 3, 1970 |

SUMMARY OF THE INVENTION

It has now been discovered that a substantially pH-stable liquid concentrate can be provided by neutralizing phosphoric acid with an organic amine having a $pK_b$ within the range of about 3 to about 10, preferably 3 to 5, thereby obtaining an organic ammonium phosphate salt (preferably an organic ammonium dihydrogen phosphate salt) solution having a pH within the range of about 3.0 to about 5.5. This salt solution can contain minimal amounts of alkali metal cation, e.g. less than 1% by weight even in the most concentrated form of a solution. Since the concentrate is intended primarily for use in the phosphatizing of ferrous surfaces, it is also preferred that the concentrate and the use solution be free or substantially free of chromium-containing compounds. When the phosphoric acid is neutralized with the amine, it is preferred to neutralize various other acidic components in the composition, which will be described subsequently. The liquid concentrate can be aqueous, in which case it can contain a relatively small proportion of water as compared to the proportion of water in a phosphatizing bath. For example, the aqueous liquid concentrate can contain less than 80 weight-% water, preferably less than 70 weight-%. Water can, if desired, be totally or substantially eliminated from the liquid concentrate. If the elimination of water results in excessive viscosity, the viscosity can be reduced with organic solvents, e.g. aromatic solvents.

These pH-stable liquid concentrates are well suited to a variety of phosphatizing methods, e.g. spray phosphatizing steam phosphatizing, and bath phosphatizing.

DETAILED DESCRIPTION OF THE INVENTION

This invention seeks to accomodate several of the trends in the art of phosphatizing. Thus, concentrates of this invention — though they certainly can be used in a manner analogous to prior art solid phosphatizing compositions — are well suited to dispensing and metering directly from a shipping drum to a spray head or phosphatizing bath. In its simplest aspect, this dispensing/metering method involves only two metered streams: a flow of concentrate from the shipping drum (or other suitable container) and a flow of plain water. The metering of these two streams is arranged to provide at least 1:5 dilution by weight (concentrate:water), but preferably not more than 1:250 (concentrate:-water by weight). The type of metering and/or dispensing devices used is not critical so long as the effect is to provide proper proportioning of the two streams. Proportioning can be done by pressure, flow rate, or the like. Those types of dispensing, metering, and proportioning methods which are adaptable to automation are preferred.

Second, the preferred embodiments of compositions of this invention include surface active agents which can have a cleaning effect upon metal surfaces. These preferred embodiments are useful in the so-called three-step phosphatizing processes, wherein cleaning and phosphatizing are carried out more or less simultaneously in the first step, the second and third steps being the water rinse and the after-treatment rinse. In the so-called five-step process, wherein cleaning of the metal surface is an entirely separate step, there is much less of a need for such surface active agents in the composition.

Third, compositions of this invention have adequate pH stability, even at or near the endpoint for the neutralization reaction:

$$H_3PO_4 + OH^- \rightarrow H_2PO_4^- + H_2O$$

That is, the operator of the phosphatizing process can be reasonably certain that the pH will stay within the 3.0–5.5 range without constant adjustment, e.g. the sort of constant adjustment wherein small increments of phosphoric acid are added to repeatedly neutralize increasing alkalinity which gets into the phosphatizing solution from alkaline rinses or the like. Accordingly, in the preferred embodiments of this invention, one or more buffering compounds are used to reduce the slope of the pH vs. NaOH-concentration curve. Furthermore, it is a feature of this invention that such buffering compounds have sufficient water solubility to be compatible with the first goal — that is, the goal of providing a liquid concentrate. It is particularly preferred to introduce buffering compounds in acidic form and neutralize them with the same amine used to neutralize the phosphoric acid in the concentrate. The resulting organic ammonium buffer salts have been found to possess good water solubility.

Fourth, and in some respects, most important, it has been found that the phosphatizing compositions of this invention are surprisingly efficient at relatively low temperatures, including normal ambient temperatures such as 20°–25° C. Phosphatizing times (e.g. immersion times in the case of phosphatizing baths) are comparable to times used with prior art compositions at relatively elevated temperatures. In those instances where phosphatizing compositions of this invention are not as efficient at the operating temperature as might be desired, efficiency can safely be increased through the use of accelerator systems, provided that such systems contain a minimum of alkali metal cations. In fact, it has been found that alkali metal cations can, if necessary, be totally eliminated from the accelerator system. One method for accomplishing this objective is to form organic ammonium molybdate salts and use such salts in place of the conventional sodium molybdate or organic ammonium aromatic compounds in place of nitrobenzene sodium sulfonates, etc.

Fifth, liquid concentrate compositions of this invention have good storage stability as well as pH stability. Phase separation — which could seriously interfere with automatic dispensing and metering of the concentrate — can be eliminated or kept to a minimum. Salting out or precipitation of solutes appears to be as well controlled and prevented as liquid phase separation. This storage stability does not appear to be limited to ideal shipping and storage conditions. Liquid or solids phase separation is also minimized down to 0° C. and even, to some extent, under freeze-thaw conditions.

Although the formulation of an essentially complete liquid concentrate which requires only 1:5 – 1:250 dilution to be usable is the simplest approach with respect to automated dispensing, it is a somewhat more complicated approach with respect to formulation of the concentrate itself. For example, by using a two-part concentrate system, phase separation problems can be dealt with in a manner which may not even require the use of surface active agents, coupling solvents, or the like. Automatic dispensing and proportioning of a two-part system can, however, actually involve three streams: a stream of part A, a stream of part B, and a plain water stream. It would ordinarily be impractical to pre-dilute either part of the two-part concentrates.

A factor which is common to all embodiments of this invention, whether one-part or two-part, is the formation of organic ammonium salts of phosphoric acid, typically the dihydrogen phosphate salts. In the context of this invention, the word "phosphate" should be understood to include salts wherein the anion is orthophosphate, monohyrogen orthophosphate, dihydrogen orthophosphate, or the corresponding polyphosphates.

In the preferred embodiments of this invention, the organic amine neutralizes many other acids in the composition besides phosphoric acid to form one or more of the following additional salts: an organic ammonium buffer salt, an organic ammonium molybdate accelerator salt, an organic ammonium sulfonate hydrotropic wetting agent and/or coupling agent and the like. It is a particularly convenient feature of this invention that, if desired, a single organic amine can be used to form all these salts. The salts can be formed in various stages of the manufacturing of the concentrate, e.g. they can be pre-formed or, more conveniently, they can be formed in a one-shot process, wherein all the acids, surface active agents, and the like are blended with the amine in a single mixing step to form the concentrate. Still another alternative is to form the organic ammonium salts in situ on the job, e.g. with a two-part system wherein part A contains the acids and part B contains the amine. As noted previously, from the standpoint of simplicity and reliability of proportioning and operating of the phosphatizing process, it is preferred that the concentrate be completely premixed, so that the only ingredient lacking is water. It is also preferred that the concentrate be suitable for mixing with tap water of any degree of hardness. The complete pre-mixing of the acid and the amine in the concentrate appears to be the most effective way to ensure compatibility with any type of tap water. As for the water (if any) used to make the concentrate itself, tap or softened water is also suitable here, although de-ionized water is preferably from the standpoint of exacting quality control. If no water is used, organic solvents can be used, if necessary, to reduce viscosity.

The components preferred for use in compositions of this invention will now be described in detail. The nature and the proportions of components can vary depending upon the method of phosphatizing (e.g. immersion, spraying, etc.), the method of storage (one-part vs. two-part systems), the time and temperature limitations of the phosphatizing process, the weight of coating desired, the amount of foam likely to be formed during use of the composition, the degree of alkalinity in the rinses preceding phosphatizing, occupational safety requirements, pH stability requirements, and similar factors. The most complete type of concentrate includes the organic amine and several acids which it neutralizes, i.e., phosphoric acid (or pyrophosphoric acid), the acid form of the buffering compound, an acid or acid anhydride form of an accelerator compound (although very small amounts of sodium salt accelerator compounds can be tolerated), and the acid form (e.g. sulfonic acid form) of various surface active agents. In these most complete compositions, other accelerators and other surface active agents (e.g. nonionic wetting agents and defoamers) can also be included. However, it should be borne in mind that, depending upon the factors mentioned previously, one or more of these ingredients can be omitted.

THE PHOSPHATIZING AGENT

It is preferred that the phosphatizing agent be phosphoric acid ($H_3PO_4$), which, at some point in the practice of this invention (preferably during the manufacture of the liquid concentrate) is reacted with the amine to form an organic ammonium phosphate, preferably to form an organic ammonium dihydrogen phosphate, i.e. an acid phosphate salt of an organic amine. Ordinarily, it is not convenient to use 100% phosphoric acid, an aqueous phosphoric acid solution ranging in concentration from 50 to 95% being preferred; polyphosphoric acid can also be used.

THE BUFFERING COMPOUND

A wide variety of acidic materials can be neutralized with organic amines to form organic ammonium buffer salts. These acidic materials, like the phosphoric acid, are typically not in 100% concentrated form, but are in aqueous solutions ranging in concentration from 10 to 95%. The acid precursor of this organic ammonium buffering compound can be relatively weak or moderately strong. The preferred acids from which the organic ammonium buffering salts are formed are fluosilicic acids, fluozirconic acid ($H_2ZrF_6$), fluotitanic acid ($H_2TiF_6$), and the like. Organic carboxylic acids which are water soluble, which form water soluble organic salts, and which have a $pK_1$ within the range of about 2 to 7, e.g. acetic acid, also can be used. Due to the risk of substantial hydrolysis of the organic ammonium salts of acetic acid in the pH range of 3.0–5.5, however, there can be a serious odor problem with this acid. The odor problem can be overcome through the use of hydroxycarboxylic acids, e.g. lactic acid, but, in any event, the aforementioned inorganic fluorinated acids are preferred, i.e. acids of the formula $H_2MF_6$, wherein M is an element of Group IVA or Group IVB of the Periodic Table.

Although the alkali metal salts (e.g. N*a* and K salts) of the $H_2MF_6$ acids are sparingly soluble at best — a solubility in water of 0.8% or 0.9% is typically about the best one can hope for — organic ammonium salts (i.e. amine salts) of these acids have very good water solubility. The simple ammonium ($NH_4$) salts of these acids also tend to be more water soluble, by at least about one order of magnitude. However, $NH_4H_2PO_4$ is less water soluble than the corresponding sodium dihydrogen phosphate. Accordingly, the use of ammonia as the base for neutralizing acids in the concentrate of this invention would provide a step forward for the inorganic buffering compounds, but a step backward for the phosphatizing agent.

Fortunately, the organic ammonium salts of both phosphoric acid and the $H_2MF_6$ acids have water solubility well suited to the formulation of a concentrate, i.e. a phosphatizing solution containing less than about 80 weight percent water, more preferably 20–70%.

ORGANIC AMINE NEUTRALIZING AGENTS

Organic amines used to neutralize the phosphoric acid, the $H_2MF_6$ acid, and other acidic materials in the composition are ordinarily monofunctional (with respect to amine functionality) and are ordinarily at least strong enough to form salts which, if hydrolyzed in 0.1 molar concentration, will result in an aqueous solution with a pH within the range of about 3.0 to about 5.5, preferably from about 3.8 to about 5.2, particularly within the temperature range of 20°–70° C. Thus, these organic amines will typically have a $pK_b$ ranging from about 3 to about 10, preferably 3 to 5. (In this context, the $pK_b$ value refers to −1 times the log of $K_{diss}$, the dissociation constant.) Although these amines are ordinarily monofunctional in their salt-forming capabilities, they can contain other functional groups such as oxo radicals (hydroxyls, ethers, etc.) and the like. With respect to phosphoric acid, formation of the dihyrogen phosphate is preferred, in which case one equivalent of the amine reacts with one acid equivalent of the phosphoric acid in accordance with the equation:

$$R_3N + H_3PO_4 \rightarrow (R_3NH)H_2PO_4$$

The amine, represented in this formula by $R_3N$ can be primary, secondary, or tertiary, primary and secondary amines being preferred. The organic radicals substituted on the nitrogen atom are ordinarily aliphatic, substituted aliphatic (e.g. hydroxyaliphatic), cycloaliphatic, or any other organic group which does not have an adverse inductive effect or dislocation effect upon the unbonded pair of electrons on the nitrogen. Thus, aromatic substituents are less preferred, because the dislocating effect of the aromatic ring can raise the $pK_b$ above the desired range. Among the preferred amines are the alkanol amines (e.g. monoethanolamine, diethanolamine, the propanol amines, etc.), water soluble lower alkyl amines (i.e. the $C_1$-$C_6$ monoalkyl amines, the $C_1$-$C_4$ dialkyl amines, etc.), cyclohexyl amine, and heterocyclic amines such as morpholine. Alkanol amines such as monoethanol amine are preferred for their coupling capability, provided by the hydroxy (particularly the hydroxyethyl) group. Furthermore, monoethanol amine is lower in toxicity than the alkyl amines.

These amines, for the most part, are gases or liquids. They can be added to the concentrate as such or in concentrated aqueous solutions.

SURFACE ACTIVE AGENTS

Preferred embodiments of the concentrates of this invention can contain surfactants for performing a variety of functions including wetting and lowering of surface tension, cleaning, emulsifying, foam control, and coupling (liquid phase stabilization and prevention of phase separation). Some of the surfactants can perform more than one of these functions, but it is not necessary that any surfactant have a multi-purpose capability. For coupling, hydrotropic surfactants are preferred, and among the optimum selections of hydrotropic couplers are the organic phosphate esters and the aromatic sulfonic acids which are neutralized with the amines to form their respective ammonium salts. The aromatic sulfonic acids used for coupling are preferably free of straight-chain alkyl substituents having more than two or three carbon atoms. Thus, a particularly preferred aromatic sulfonic acid for formation of a coupling agent is xylene sulfonic acid. Two or more of the same or different types of hydrotropic coupling agents can be used in combination, and some of these also have wetting and/or detergency effects.

Particularly strong detergent effects can be obtained with long-chain alkyl benzene sulfonic acids nuetralized with the amine to form amine sulfonates. The long alkyl chains can range from 8 to 33 carbons (e.g. 12 to 24 carbons) and are preferably straight rather than branched. Although there is some risk that even the amine sulfonates derived from these long chain alkyl sulfonic acids may have foaming effects which would be undesirable in a spray-type phosphatizing process, such foaming action would present little or no problem in a phosphatizing bath.

In concentrates for spray-type phosphatizing, foam control can be desirable. A variety of low-foaming or defoaming surfactants are commercially available for this purpose. Most of these foam control agents belong to the class of surfactants commonly referred to as "nonionics". The nonionic surfactants typically contain an oxyalkylene chain made up of at least two or three oxyethylene groups and, in some instances, oxypropylene groups. The objective in any event is to provide a low-foaming or defoaming hydophobe/hydrophile balance. If the nonionic structure contains hydrophobic capping groups such as aromatic radicals or alkyl radicals having more than three carbon atoms, the oxyalkylene chain can be made up mostly or entirely of oxyethylene units. On the other hand, if the nonionic is capped or terminated with a hydrophilic group (e.g. OH), the oxyalkylene chain will typically contain at least several percent of oxypropylene units, in some instances, an entire oxypropylene polymer block.

Among the preferred nonionic surfactants are the ethoxylated alcohol benzyl ethers made according to U.S. Pat. No. 3,444,242, Rue et al, issued May 13, 1969. Other known nonionic surfactants include those described in the following U.S. Pat. Nos.:

| U.S. Pat. | Patentee | Date |
|---|---|---|
| 3,048,548 | Martin, et al | August 7, 1962 |
| 3,036,130 | Jackson, et al | May 22, 1962 |
| 3,082,172 | Temple, et al | March 19, 1963 |
| 3,334,147 | Brunelle, et al | August 1, 1967 |
| 3,549,543 | Kiestahler, et al | December 22, 1970 |
| 3,899,387 | Freis | August 12, 1975 |

Many of these nonionic surfactants are also liquids; however as in the case of other components of the concentrate composition, they can be introduced as concentrated solutions.

Organic phosphate esters are nonfoaming or low-foaming hydrotropes described as free acid of complex organic phosphate esters. Among those useful are commercial products designated Antara LP-700 (GAF Corp.), Emcol TS-210 (Witco Chemical Corp.) and PE-005 (Hodag Chemical Corp.). These phosphate esters are especially useful in spray applications where foaming is not desirable.

The phosphate esters can be hydrotropic, as can aromatic compounds such as xylene sulfonates. The aromatic hydrotropes and phosphate ester hydrotropes can be used in combination, and such combined use is particularly desirable in concentrates containing nonionic surfactants of limited solubility, e.g. oxyalkylene — containing nonionics of the type disclosed in U.S. Pat. No. 3,444,242 (Rue, et al), issued May 13, 1969. Indeed, in the presence of such surfactants, the combination of the two different hydrotropes (e.g. in proportions ranging from 10:90 to 90:10) appears to function better than either hydrotrope by itself.

ACCELERATOR SYSTEMS

Where the time available in the phosphatizing zone (i.e. the bath, chamber, spray pattern, or the like) is no object, accelerators are not absolutely essential even for low temperature (20°–70° C.) phosphatizing. However, it has been a consistent goal in the phosphatizing art to reduce phosphatizing times to less than 15 minutes (e.g. 30 seconds - 5 minutes). During this short exposure of 15 minutes or less, the iron phosphate coating weight (i.e. the metallic iron converted chemically to nonmetallic iron phosphate) should reach the 10–100 milligram per square foot range (e.g. 30–50 mg/ft$^2$). To obtain efficiently a coating of 25 mg/ft$^2$ or even 10 mg/ft$^2$ at temperatures below 85° C. or, worse, below 70° C., is extremely difficult without the aid of an accelerator. The term "accelerator" in the phosphatizing art generally refers to an oxidizing agent which helps to keep dissolved iron in the phosphatizing zone in the ferric, i.e. iron (III) state. As is known in the art, it is the ferric state which provides maximum precipitation of iron phosphates onto the ferrous metal surface.

It has long been known that chlorates and oxidized nitrogen-containing radicals can help to provide the desired accelerating effect. For example, nitrites, nitric acid and nitrates (which can be in equilibrium with nitrites when in use) have been used. In the context of this invention, organic nitro compounds are preferred, including nitroaromatics and nitroguanadine. Among the preferred nitroaromatics are nitrobenzene, dinitrobenzene, nitroaniline, and nitroaromatic sulfonic acids or salts. (The nitroaromatic sulfonic acids can be reacted with the amine to form organic ammonium sulfonates, if desired.)

The accelerator system is the one portion of the liquid concentrate wherein small amounts of alkali metal cations can be permitted. It is preferred, however, that the total amount of alkali metal cation in the concentrate be less than 1% by weight. It is even more preferable that the combination of the alkali metal with its anion not exceed a level that will equivocate to an oversaturation of the complex fluoride buffers. Of the organic sodium salt accelerators, nitroaromatic sodium sulfonates are preferred, e.g. m-nitrobenzene sodium sulfonate.

Inorganic compounds have also been used as accelerators, e.g. the molybdate salts. If alkali metal molybdates are used in concentrates of this invention, it is preferred that the total alkali metal molybdate concentration in the concentrate be far less than 1% by weight, more preferably less than 0.2% by weight. Even at the 0.2% level, there is some risk that precipitation of sodium silicofluoride can occur. One preferred approach to this problem is to eliminate the alkali metal in the molybdate salt and substitute the organic ammonium radical as the cation. This can be accomplished, for example, by reacting molybdic acid anhydride (i.e. molybdenum trioxide) with one of the aforementioned amines to form the organic ammonium salt. This reaction can be carried out along with all the other neutralizations, including the neutralization of the phosphoric acids to an organic ammonium dihydrogen phosphate.

PROPORTIONS

The following table gives broad, preferred, and optimum proportions of the various components described previously. In footnotes to the Table, it is pointed out that certain of the components are not necessary or desirable in concentrates for phosphate baths or spray compositions.

| Proportions Used in Concentrate in Percent by Weight | | | |
|---|---|---|---|
| Component | Broad | Preferred | Optimum |
| water[1] | Q.S. | Q.S. | Q.S. |
| 75% $H_3PO_4$[2] | 10–50 | 20–30 | 25 |
| Buffer acid, e.g. $H_2MF_6$ (100%) | 0.25–10.0 | 1.0–3.0 | 1.2 |
| Amine, e.g. $HOCH_2CH_2NH_2$ | As needed to neutralize acids to pH of 3.0–4.0 in concentrate. Proportions will vary greatly with acid concentration and molecular and equivalent weights. | | |
| Surfactants | | | |
| (a) organic phosphate ester[3] | 0.1–30.0* | 2.0–15.0* | 5.0–8.0* |
| (b) oxyalkylene-containing nonionic[3] | 0.1–10.0 | 1.0–2.5 | 1.8 |
| (c) n-alkylbenzene sulfonic acid (to be neutralized with amine)[4] | 0.1–10.0 | 1.0–3.0 | 2.0 |
| (d) hydrotropic aromatic sulfonic acid (to be neutra- | 30.0–1.0* | 15.0–2.0* | 8.0–5.0* |

-continued

| Component | Proportions Used in Concentrate in Percent by Weight Broad | Preferred | Optimum |
|---|---|---|---|
| lized with amine) | | | |
| Accelerator System | | | |
| (a) molybdenum trioxide[5] | 0.02–0.4 | 0.03–0.25 | .06–.22 |
| (b) sodium molybdate[5] | 0.025–0.5 | 0.05–0.3 | .08–.25 |
| (c) organic nitro compound | 0.1–5.0 | 0.2–1.50 | 0.25–1.25 |

[1]Preferred, but optional, in all concentrates; can be omitted or replaced with organic solvent.
[2]Preferred ratio of $H_3PO_4$: buffer is 10–20:1, broad range can be 5–40:1.
[3]Useful in spray-type phosphatizing concentrate, not required for bath type.
[4]Useful in bath-type phosphatizing concentrate, not required in spray type.
[5]Generally equivalent, both not needed. Sodium molybdate better suited for spray type, trioxide preferred in bath type; used primarily to control bronzing.
[6]See previous discussion regarding combinations with phosphate esters.

MANUFACTURE AND USES OF CONCENTRATE

As pointed out previously, concentrates of this invention should be diluted at least 1:5 but preferably not more than 1:250 for use in virtually any type of phosphatizing zone including zones provided by sprays (spray washers), baths, steam guns, pressure, etc. The preferred dilution range is from 1:20 to 1:50. Use solutions thus typically contain about 0.5 to 15% by weight of the concentrate, more preferably 2–5% by weight. The concentrates are preferably free of chromium-containing compounds (except for incidental amounts due to impurities or the like, e.g. amounts less than 0.1%). Using the nomenclature of Ross et al, column 1, which is incorporated herein by reference, the use solutions produced from concentrates of this invention are classifiable as "noncoating", "iron", and "iron-on-iron". Thus, phosphatizing compositions of this invention provide dihydrogen phosphate ions which can dissociate to form hydrogen ions and hydrogenphosphate ions. The hydrogen ions can attack the ferrous metal surface being treated to produce iron phosphate (e.g. ferrous or ferric hydrogenphosphate) crystals which adhere to the ferrous metal surface. Virtually any ferrous metal surface (iron, steel, etc.) can be treated. Good results are obtained at normal ambient temperatures and moderately elevated temperatures (e.g. 25°–35° C.) which are not overly energyconsuming can also be used. (For energy conservation, operating temperatures below 50° or 55° C. are preferred.)

The preferred manufacturing procedure is as follows:

1. Charge $H_3PO_4$ and buffer ($H_2MF_6$) and all other acids (e.g. sulfonic acids) to mixer.

2. Add sufficient amine, e.g. primary amine ($RNH_2$) for the reaction:

$$H_3PO_4 + H_2MF_6 + 3RNH_2 \rightarrow (RNH_3)\ H_2PO_4 + (RNH_3)_2SiF_6$$

and, if applicable, for the reactions:

$$R^1SO_3H + RNH_2 \rightarrow (RNH_3)\ SO_3R^1$$

$$MoO_3 + H_2O + 2RNH_2 \rightarrow (RNH_3)_2\ MoO_4$$

organic ammonium molybdate.

3. Add surfactants, including coupling agents, if needed.

In the following nonlimiting, illustrative Examples, all parts and percentages are by weight unless otherwise indicated.

EXAMPLE 1

Immersion Type Phosphatizing Concentrate

The following components in the indicated amounts were blended to form monoethanolamine salts. The monoethanolamine salt of xylene sulfonic acid appears to provide good coupling effects.

| | Amounts, Wt. % |
|---|---|
| Water | 45.8 |
| Phosphoric Acid (aqueous, 75 wt. % conc.) | 26.0 |
| Fluosilicic Acid (aqueous, 30 wt. % conc.) | 6.0 |
| m-Nitrobenzene sodium sulfonate (accelerator) | 1.0 |
| Molybdenum trioxide (accelerator and anti-bronze agent) | 0.2 |
| n-Alkylbenzene sulfonic acid | 2.0 |
| xylene sulfonic acid | 3.0 |
| Monoethanolamine | 16.0 |
| | 100.0 |

EXAMPLE 2

Spray Type Phosphatizing Concentrate

Monoethanolamine salts were formed as in Example 1.

| | Amounts, Wt. % |
|---|---|
| Water | 40.55 |
| Phosphoric acid, aqueous, 75% | 23.10 |
| Fluosilicic acid, aqueous, 30% | 5.33 |
| xylene sulfonic acid | 6.76 |
| "ANTARA LP-700" (trademark for organic phosphate ester surfactant) | 6.22 |
| Monoethanolamine | 15.81 |
| Sodium molybdate | 0.09 |
| m-Nitrobenzene sodium sulfonate | 0.36 |
| $RO(CH_2CH_2O)_nCH_2C_6H_5$, ethoxylated alcohol benzyl ether, U.S. Pat. 3,444,242 | 1.78 |
| | 100.00 |

This concentrate of this Example was diluted to 3 wt.% concentration with water and tested at various pH's and temperatures, using standard industrial Q panels. The phosphatizing time in all cases was 2 minutes. In Table I, below, results are given in coating weights (mg/ft²).

Table I

Coating Weights for Example 2 Concentrate at 3% Concentration

| pH | Temperature 80° F. | 90° F. | 105° F. | 120° F. | 160° F. |
|---|---|---|---|---|---|
| 5.6 | 17 | — | — | — | — |
| 4.3 | 43 | — | — | 88 | 133 |
| 3.5 | 38 | — | — | — | — |

Table I-continued

| Coating Weights for Example 2 Concentrate at 3% Concentration | | | | | |
|---|---|---|---|---|---|
| | Temperature | | | | |
| pH | 80° F. | 90° F. | 105° F. | 120° F. | 160° F. |
| 3.0 | 40 | 43 | 58 | 60 | — |

A further run was made at 4.2% concentration and a temperature of only 75.2° F. A coating weight of 48.2 mg/ft$^2$ was obtained.

EXAMPLE 3

This example illustrates a suitable liquid concentrate formula wherein the amine salts were formed with ethylamine.

| | Weight Percent |
|---|---|
| Water | 67.65 |
| $H_3PO_4$, aqueous, 75% | 20.00 |
| Fluosilicic acid, aqueous, 30% | 2.50 |
| m-Nitrobenzene sulfonic acid | 0.50 |
| Ethylamine, aqueous, 70% | 9.30 |
| Sodium molybdate | 0.05 |
| | 100.00 |

The pH of this concentrate, prior to dilution with water, was 3.8.

EXAMPLE 4

This Example illustrates a suitable liquid concentrate formula wherein the amine salts were formed with morpholine.

| | Weight Percent |
|---|---|
| Water | 56.64 |
| Phosphoric acid, aqueous, 75% | 24.00 |
| Fluosilicic acid, aqueous, 30% | 3.00 |
| m-Nitrobenzene sulfonic acid | 0.60 |
| Sodium molybdate | 0.06 |
| Morpholine | 15.70 |
| | 100.00 |

What is claimed is:

1. A method of treating a ferrous metal surface with a phosphatizing composition comprising the steps of:

a. contacting said ferrous metal surface, in a phosphatizing zone, with an organic ammonium phosphate salt solution formed by diluting a liquid concentrate with water in the salt:water ratio of at least 1:5 but less than about 1:250, said concentrate comprising said organic ammonium salt dissolved in water, said concentrate containing less than 1% by weight of any alkali metal containing compound and containing a buffering amount, up to 10% by weight, of an organic ammonium salt buffering compound for stabilizing the pH of said concentrate within the range of about 3.0 to 5.5, said phosphate salt solution having a substantially stabilized pH within the range of about 3.0 to about 5.5, said phosphate salt solution comprising 0.15–15% by weight of said phosphate salt, the organic amine of said organic ammonium salt having a $pK_b$ within the range of about 3 to about 10; said contacting being continued until an iron phosphate coating weight of at least about 10 mg/sq.ft. is obtained on said ferrous metal surface; and b. rinsing the resulting coated ferrous metal surface with an aqueous rinse composition.

2. A method according to claim 1 wherein said concentrate is dispensed from a storage container, diluted with water, and introduced into a phosphatizing zone prior to and during said steps (a) and (b).

3. A method according to claim 1 wherein said concentrate is substantially continuously dispensed from a storage container and substantially continuously diluted with water to form said aqueous phosphatizing solution, and the resulting aqueous phosphatizing solution is sprayed onto said ferrous metal surface in said phosphatizing zone, whereby the duration of contacting time for said step (a) is less than about 15 minutes.

4. A method according to claim 1 wherein the contacting time of said step (a) is less than 15 minutes, and the temperature of the said phosphatizing solution in said phosphatizing zone is less than about 160° C.

5. A method according to claim 4 wherein said contacting time is less than two minutes and said temperature is within the range of normal ambient temperatures up to about 50° C.

6. A method according to claim 1 wherein said buffering compound being the salt of an acid having a $pK_a$ within the range of 2 to 7 and a said organic amine.

7. A method according to claim 6 wherein said concentrate contains at least one hydrotrope or surface active agent selected from the group consisting of:

i. an organic amine salt of a phosphate ester,
ii. an organic acid salt of a said organic amine,
iii. an oxyalkylene-containing nonionic surfactant,
iv. an organic amine salt of an anionic hydrotrope,
v. an organic amine salt of an anionic surfactant.

8. A method according to claim 1 wherein the acid precursor of said buffering compound is an acid of the formula $H_2MF_6$, wherein M is an element of Group IVA or Group IVB of the Periodic Table.

9. In a method of phosphatizing a ferrous metal surface, the improvement which comprises:

contacting said ferrous metal surface with the following concentrate composition, diluted with water in the weight ratio of concentrate:water ranging from about 1:5 to 1:250,

| Component | % by weight |
|---|---|
| water | less than 70 |
| phosphoric acid | 10–30 |
| acid precursor of a buffering compound, for maintaining a pH within the range of 3.0 to 5.5 | 1–10 |
| wetting agent | 1–15 |

monofunctional amine: at least one equivalent per equivalent of said phosphoric acid and said acid precursor of a buffering compound, said amine being selected from the group consisting of an alkanolamine, an alkyl amine, a cycloaliphatic amine, and a heterocyclic amine.

10. A stable liquid aqueous concentrate for phosphatizing of metal surfaces comprising:

| Component | % by weight |
|---|---|
| a. water | Q.S. to 100 |
| b. organic ammonium dihydrogen phosphate | 20–50 |
| c. an organic ammonium salt buffering compound, for maintaining a pH within the range of | 0.25–10 |

-continued

| Component | % by weight |
|---|---|
| 3.0 to 5.5 | |

said concentrate having a pH within the range of 3.0 to 5.5 and containing less than 1% by weight of ions of an alkali metal, the organic amine of said organic ammonium phosphate and said organic ammonium salt buffering compound having a $pK_b$ ranging from about 3 to about 10 and being selected from the group consisting of an alkanolamine, an alkylamine, a cycloaliphatic amine, a heterocyclic amine, and mixtures thereof; said buffering compound being capable of forming alkali metal salts with a solubility of less than 1% by weight in water.

11. A concentrate according to claim 10 consisting essentially of the following components and their neutralization products:

| Component | % by weight |
|---|---|
| a. water | less than 70 |
| b. phosphoric acid, aqueous, 75 wt. % | 20–30 |
| c. monoethanolamine, ethyl amine, or morpholine | sufficient for neutralization of all acidic components |
| d. an accelerator capable of forming an organic amine salt when reacted with (c) | |
| e. an anionic coupling agent capable of forming an organic amine salt when reacted with (c) | 1–30 |
| f. nonionic surfactant | 1–10 |
| g. $H_2MF_6$, wherein M is an element of Group IVA or Group IVB of the Periodic Table. | 0.25–10 |

12. A phosphatizing solution comprising said components of claim 11, combined and diluted with water, the weight ratio of the combination of components to water being within the range of 1:5 to 1:250.

13. A concentrate according to claim 10 wherein the acid precursor of said buffering compound is an acid of the formula $H_2MF_6$, wherein M is an element of Groups IVA or IVB of the Periodic Table.

* * * * *

UNITED STATES PATENT AND TRADEMARK OFFICE

CERTIFICATE OF CORRECTION

PATENT NO. : 4,017,335

DATED : April 12, 1977

INVENTOR(S) : James E. Maloney

It is certified that error appears in the above-identified patent and that said Letters Patent are hereby corrected as shown below:

Column 2, line 57, "surfaces" should read --surface--.
Column 3, line 7, "particularly" should read --particularly--.
Column 4, line 5, "phatizing steam" should read --phatizing, steam--.
Column 5, line 48, "monohyrogen" should read --monohydrogen--.
Column 6, line 12, "ably" should read --able--.
Column 6, line 67, "$pK_1$" should read --$pK_a$--.
Column 7, line 47, "dihyrogen" should read --dihydrogen--.
Column 11, line 61, "$(RNH_3)_2MoO_4$" should read --organic ammonium molybdate--.
Column 11, line 62, delete "organic ammonium molybdate".
Column 13, line 14, "example" should read --Example--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*